US006439806B1

(12) United States Patent
Dillingham

(10) Patent No.: US 6,439,806 B1
(45) Date of Patent: Aug. 27, 2002

(54) PAVEMENT REPAIR MATERIAL CART

(75) Inventor: Harold W. Dillingham, Jacksonville, TX (US)

(73) Assignee: H.D. Industries, Inc., Jacksonville, TX (US)

( * ) Notice: Subject to any disclaimer, the term of this patent is extended or adjusted under 35 U.S.C. 154(b) by 0 days.

(21) Appl. No.: 09/640,225

(22) Filed: Aug. 16, 2000

(51) Int. Cl.[7] ..... E01C 23/14; E01C 23/02

(52) U.S. Cl. ..... 404/95; 404/107; 126/343.5 A; 126/343.5 R

(58) Field of Search ..... 404/87, 92, 95, 404/107, 108, 110, 111; 126/91 A, 373.1, 343.5 A, 343.5 R, 284

(56) References Cited

U.S. PATENT DOCUMENTS

| | | | | | |
|---|---|---|---|---|---|
| 1,052,578 | A | * | 2/1913 | Fitzgerald | 404/107 |
| 1,546,185 | A | * | 7/1925 | Andersen | 404/95 |
| 1,750,104 | A | * | 3/1930 | Heltzel | 404/107 |
| 1,925,636 | A | * | 8/1933 | Burket | 404/107 |
| 2,578,080 | A | * | 12/1951 | Middlestadt | 404/107 |
| 3,130,652 | A | * | 4/1964 | Newton, Sr. et al. | 404/107 |
| 3,227,055 | A | * | 1/1966 | Glade | 404/107 |
| 3,280,710 | A | * | 10/1966 | Glade | 404/107 |
| 3,466,988 | A | * | 9/1969 | Sharpe | 404/107 |
| 3,873,227 | A | * | 3/1975 | Goethe et al. | 404/107 |
| 3,946,722 | A | * | 3/1976 | Banahan | 126/343.5 A |
| 3,995,616 | A | * | 12/1976 | Schrader | 126/343.5 A |
| 4,033,328 | A | * | 7/1977 | Lohman et al. | 126/343.5 A |
| 4,196,827 | A | | 4/1980 | Leafdale | 222/146 |
| 4,353,176 | A | * | 10/1982 | Hess | 126/343.5 R |
| 4,620,645 | A | | 11/1986 | Hale | 222/146 |
| 4,630,965 | A | * | 12/1986 | Nguyen et al. | 404/107 |
| 4,831,958 | A | * | 5/1989 | Selby | 404/111 X |
| 4,944,632 | A | | 7/1990 | Dillingham | 404/111 |
| 5,291,876 | A | * | 3/1994 | Milstead | 404/95 X |
| 5,325,994 | A | * | 7/1994 | Mizialko | 404/111 X |
| 5,988,935 | A | | 11/1999 | Dillingham | 404/79 |
| 6,012,870 | A | | 1/2000 | Dillingham | 404/79 |

FOREIGN PATENT DOCUMENTS

| | | | | |
|---|---|---|---|---|
| DE | 3420844 | * | 12/1985 | 404/108 |
| GB | 2094468 | * | 9/1982 | 404/92 |

* cited by examiner

*Primary Examiner*—Heather Shackelford
*Assistant Examiner*—Jong-Suk Lee
(74) *Attorney, Agent, or Firm*—Bracewell & Patterson, LLP

(57) ABSTRACT

A portable cart for transporting and dispensing heated pavement repair materials that is capable of being moved and operated by one person, the cart applying a heated asphaltic/polymeric binder material. The cart comprises a heating chamber having an enclosed interior and providing dry radiant heat and a containment chamber located within the enclosed interior of the heating chamber, the containment chamber narrowing towards an opening. Fuel gas is used to provide dry, radiant heat to the road repair materials to create a fluid material to apply to the surface to repair. The cart further comprises a hand-operated gating means, wherein the material within the containment chamber is gravity-dispensed in a controlled manner. The cart is ideal for repairing cracks and filling expansion channels in concrete and/or asphalt roadways and driveways.

9 Claims, 3 Drawing Sheets

FIG. 1
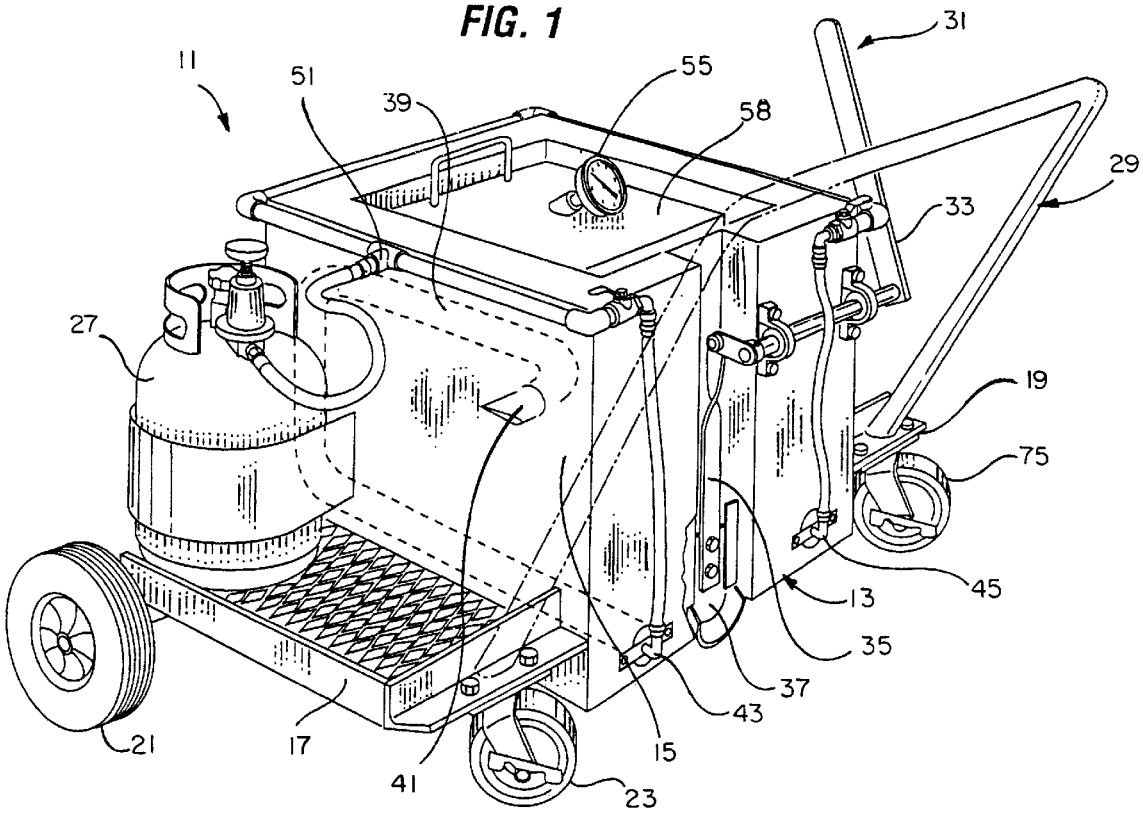
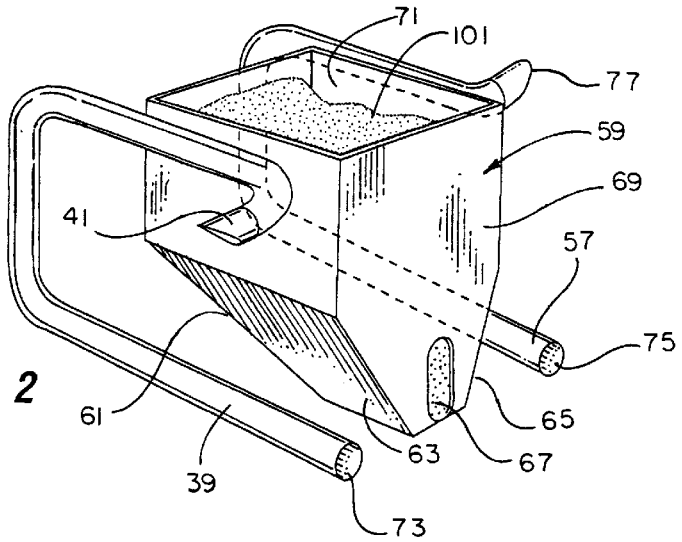
FIG. 2

PAVEMENT REPAIR MATERIAL CART

BACKGROUND OF THE INVENTION

1. Field of the Invention:

The present invention relates in general to a hand-truck or cart device for dispensing pavement repair materials, and in particular to a heated cart for forming a liquid or semi-liquid from an asphaltic/polymeric material used to repair cracks and fill channels in pavement and the like.

2. Description of the Prior Art:

In the past, as many as three vehicles were sometimes needed to repair openings and potholes in asphalt, concrete and other roadway surfaces. One vehicle provided an air compressor for use with various pneumatic repair tools which were used to dress the hole, crack or cavity to be filled. Another vehicle contained liquid asphalt tack material which would be sprayed into the dressed cavity, and a third vehicle would deliver asphalt mix material to the cavity. The asphalt would then be packed, compacted and leveled by hand to complete the repair. This is highly impractical for small repairs such as cracks in pavement, or to fill expansion channels in pavement.

Several devices have decreased the number of separate pieces of equipment necessary for road repairs. U.S. Pat. No. 6,012,870, issued Jan. 11, 2000 and assigned to the assignee of the present invention, discloses such a device, wherein a heat chamber contains a mixing chamber having a mixing means, paddles, etc., that is mechanized. The entire apparatus rests upon a skid, which is then transported by a truck or trailer. Although an improvement over using a combination of devices, this apparatus is still impractical for repairing small cracks, wherein an economic advantage is to be gained in having a single person-operated device.

Another device, U.S. Pat. No. 5,98 8,935, issued on Nov. 23, 1999, assigned to the assignee of the present invention, discloses a truck-mounted asphalt mixer that utilizes a V-shaped interior wall. That device is specifically designed to operate using dry, radiant heat sources to heat the material being stirred within. This device has the advantage of using dry, radiant heat from air-heated spaces below the heating chamber, but has the disadvantage of being large and highly mechanized, thus impractical for small jobs.

U.S. Pat. No. 4,196,827, issued Apr. 8, 1980, entitled "Portable Machine For Transporting Heated Asphalt Products For Use In Repairing Asphalt Pavement"shows a portable machine which was designed to incorporate all phases of the pavement repair into one mobile unit. The machine has a hopper for transporting asphalt mix, and a reservoir below the hopper having a heat source. The reservoir contained liquid asphalt tack material. The heat source is used to heat the liquid tack material, and the tack material is used to heat the asphalt mix in the hopper by heat transfer. Asphalt tack material is also dispensed from the tack material tank by means of spray equipment connected to a discharge valve on the rear of the truck.

In spite of being less expensive to operate in terms of material and labor, the previously described device possessed several different disadvantages. Many of these disadvantages related to the type of repair material utilized and the fact that multi-component materials were required to each job. Because multiple component materials were required for each patch job, the equipment used for transporting such components was complicated and often limited in versatility. For example, the liquid asphalt tank carried on the unit was suitable for road oils and cutbacks but was not well suited for use with asphaltic cements. Also, in the case of the device described in the '827 patent, the liquid asphalt tank was not suited for use with asphalt emulsions, because the volatile contents of the emulsions would be driven off and dry out the materials.

U.S. Pat. No. 4,944,632, issued Jul. 31, 1990, and assigned to the assignee of the present invention showed a portable unit with a separate tack oil tank which was provided with its own heat source and which was designed to prevent phase separation of the tack oil materials. While this apparatus solved the problem of tack oil phase separation, it was still designed to be employed in a multi-component repair system.

Thus, while the various prior art pavement repair devices solved several problems, they are not suitable for both small jobs such as repairing cracks, and for applying newer, asphaltic/polymeric materials that have different physical properties from traditional asphalt/aggregate compositions. In particular, smaller, one-person operated devices have heretofore been impractical due to the need for mechanization of the prior art devices. Powerful mixers have been necessary in the prior art to mix the large quantities of aggregate and asphalt, which can be highly viscous. What is needed is a means for repairing small cracks and filling expansion joints and channels that is economical and can utilize newer materials not requiring aggregate.

SUMMARY OF THE INVENTION

It is therefore one object of the present invention to provide a means for applying a new asphaltic/polymeric material to roadways that one person can operate.

It is yet another object of the present invention to provide a simple, cost effective means of applying materials to cracks and channels in roadways and other pavement areas that require filling and repair.

It is yet another object of the present invention to provide a simple means of heating and applying asphaltic materials to roadways that does not require complex agitating or stirring mechanisms.

These and other objects are achieve by providing a portable cart for transporting and dispensing heated pavement repair materials that is capable of being moved and operated by one person, the cart applying a heated asphaltic/polymeric binder material. The cart comprises a heating chamber having an enclosed interior and providing dry radiant heat and a containment chamber located within the enclosed interior of the heating chamber, the containment chamber narrowing towards an opening. The radiant heat within the heating chamber heats the material within the containment chamber to between about 150° C. and 210° C. Further, the heating chamber having the containment chamber there within is located upon a hand-driven cart.

The cart further comprises a hand-operated gating means, wherein the material within the containment chamber is gravity-dispensed in a controlled manner. The cart is ideal for repairing cracks and filling expansion channels in concrete and/or asphalt roadways and driveways. The dry, radiant heat source is at least one burner fired retort tube located in the heating chamber and at least partially surrounding the containment chamber. A tank of fuel such as propane is provided on the cart, thus making the cart a self contained unit easily operated by one person.

Additional objects, features and advantages will be apparent in the written description which follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 1 is a perspective view of the exterior portions of the cart of the invention;

FIG. 2 is a perspective view of the interior portions of the cart of the invention;

DETAILED DESCRIPTION OF THE INVENTION

Figure 3:
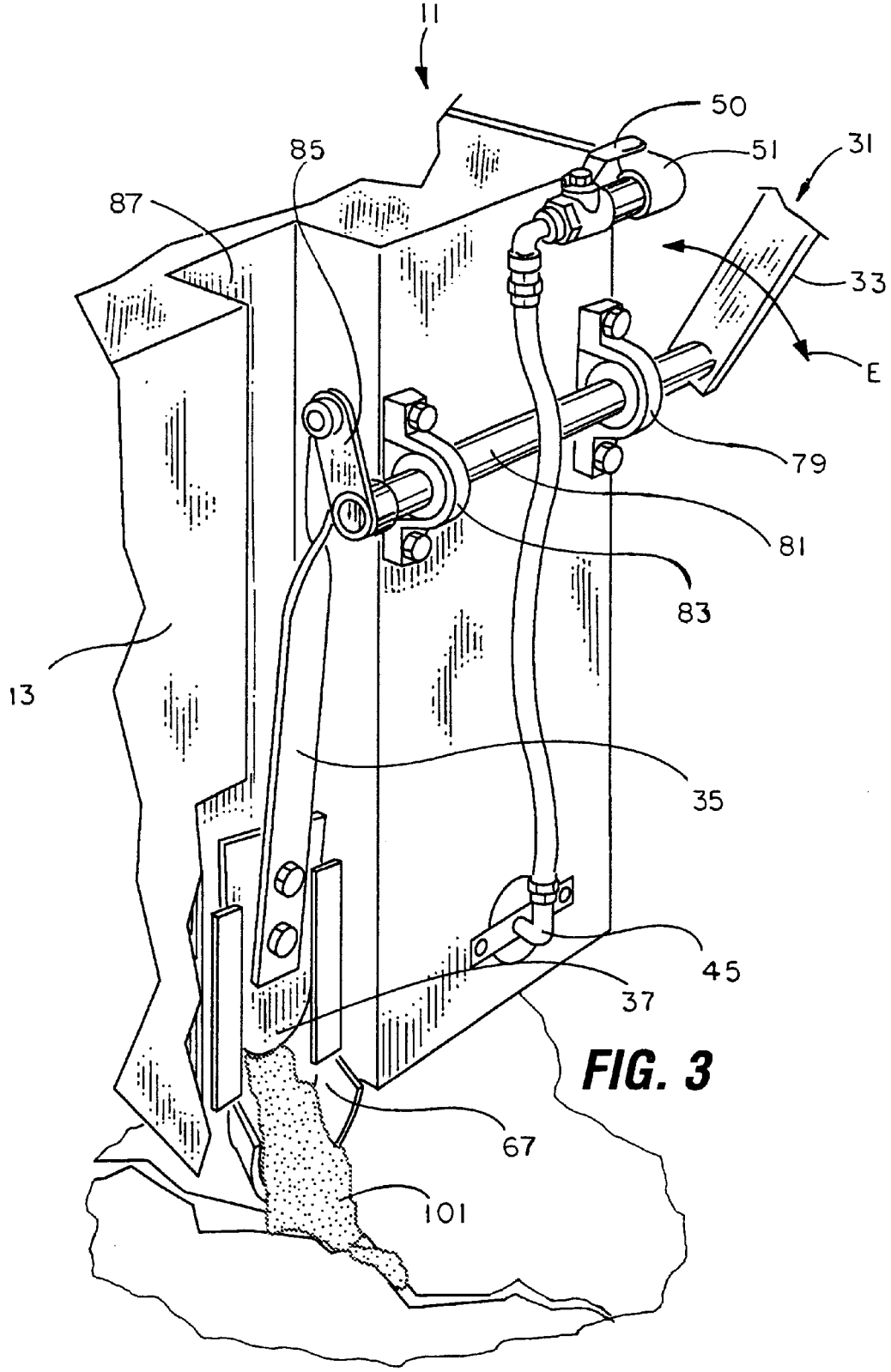
FIG. 3 is a close-up view of the gating means of the invention.

The present invention is a portable cart for transporting and dispensing heated pavement repair materials that is capable of being moved and operated by one person. The cart applies a heated asphaltic/polymeric binder material to damaged and/or cracked roadways, driveways, and other surfaces coated with concrete or asphalt. In its most basic embodiment, the cart comprises a heating chamber having an enclosed interior and providing dry radiant heat. The heat typically comes from retort tubes supplied with a fuel such as butane or propane that can be ignited in a controlled manner. A containment chamber is located within the enclosed interior of the heating chamber, the containment chamber having a sloped back face and sloped sides that, in combination, narrow towards an opening controlled by a hand-operated gating means. This allows the heated material that has become liquid or semi-liquid to flow by gravity towards the opening and out onto the area to be repaired.

The heating chamber having the containment chamber there within is located upon a hand-driven cart. The cart is self contained in that all that is necessary to heat and apply the asphaltic/polymeric material is located upon or coupled to the cart. Thus, one person can load the cart with solid material, heat the material using the tank of fuel and the fuel burners coupled to the cart, and apply the then liquified, flowable material to a surface by adjusting a gating means provided with the cart.

The radiant heat within the heating chamber heats the material within the containment chamber to between about 150° C. and 210° C., thus creating a fluid material (termed liquid or semi-liquid) that flows by gravity from the opening. The amount of heat can be controlled by a fuel control valve, and monitored with an attached thermometer. The dry, radiant heat source is at least one burner fired retort tube located in the heat chamber and at least partially surrounding the containment chamber. The retort tube can have any number of windings and turns around the containment chamber and within the enclosed interior defined by the heating chamber walls. To protect the user from burns and to allow more efficient heating, insulation is provided around the heating chamber, the insulation also possibly being reflective.

The containment chamber, or the chamber interior, is typically about 3–5 gallons in volume, and can apply about 100–110 lbs/ft$^2$ of material. One typical application of the cart is to apply asphaltic/polymeric material to expansion joints in roadways and parking lots. The cart of the invention allows for more precise application of a small or narrow amount of material in a narrow (e.g., 3 inch wide) crack or gap in a roadway as compared to larger, truck mounted hoppers in the prior art.

The invention will be described in more detail with reference to the figures, and first with reference to FIG. 1, wherein the portable cart 11 is shown. FIG. 1 shows the primary external features of the cart of the invention, where insulated heating chamber 13 has an exterior surface 15 and an interior surface (not shown here). Coupled to the heating chamber are operating platforms 17 and 19, wherein wheels 21, 23 and 25 (and another not shown) are attached to support the cart and allow its movement by one person. Also attached to the operating platforms 17 and 19 are fuel tank 27 and hand rail 29.

The hand rail 29 can be bolted, welded, or otherwise fastened to the cart 11 using appropriate fastening means. The hand rail is attached to the cart in such a way as to allow a person to position themselves along the cart and either push or pull the cart, its wheels designed to support and roll over typical asphalt or concrete roadways, or other hard surfaces. The hand rail 29 can be angled relative to the operating platforms as shown in FIG. 1, or have a smaller angle, or no angle (perpendicular) relative to the platforms.

The cart 11 also has a gating means 31 that is hand (manually) operated. The gating means comprises grip lever 33, twist arm 35, and door 37, among other parts further described below. The gating means allows the user of cart 11 to control the rate at which the asphaltic/polymeric binder flows from the cart onto the pavement or ground surface. For example, the user may pull or push the grip lever 33 only partially in one direction, thus allowing only partial flow of material from the cart. It is to be understood that the gating means 31 can take many various forms, and also be mechanized. The embodiment shown in FIG. 1 is for illustrative purposes only, showing one preferred embodiment. For example, the grip lever 33 may be placed on other portions of the cart from that shown in the figures, and can take various forms. The operation of the present embodiment of the gating means will be described in greater detail below.

The asphaltic/polymeric material that is held within the containment chamber of the cart is heated primarily by dry, radiant heat supplied by fuel burners that burn butane or propane (or other) fuel through retort tubes located within the interior of the cart. Shown in FIG. 1 is one retort tube 39 (dashed line) having an outlet 41 and fuel burner inlet 43. Fuel burner inlet 45 is coupled to another retort tube on the opposing side of the cart, not shown in this figure. The retort tube can have one or a plurality of windings that increases its length and surface area within the cart, the retort tube 39 being only one possible embodiment.

The retort tubes are coupled to fuel line 51 which forms duel connections to fuel burner inlets 43 and 45. The cart also has a hinged top 53, the top also having a thermometer 55 for measuring the temperature of the material being heated within the cart's interior containment chamber. Material is typically loaded into the top of the cart, the top 53 in an open position during loading and closed during normal operation.

The containment chamber and retort tubes are described in greater detail with reference to FIG. 2. Containment chamber 59 is surrounded by retort tubes 39 and 57, both having retort inlets 73 and 75, and outlets 41 and 77, respectively. The containment chamber is designed in general to have sloping sides that narrow towards opening 67, thus urging heated/melted fluid material through the opening via gravity. The chamber 59 has a sloped back face 61, and sloping sides 63 and 65. Although the sides are shown having a dual face, the sides may be continuously sloping from top to bottom. Front face 69 is typically flat and perpendicular to the ground once placed within the cart 11. Further, in the present embodiment, the opening 67 is flush with the front face 69 to facilitate the operation of the door 37. The material 101 located within the chamber interior 71 is heated to a liquid or semi-liquid state by the retort tubes and then allowed to flow from the containment chamber through opening 67.

The gating means 31 of the invention is further described with reference to FIG. 3, wherein further detail is shown. The gating means comprises the grip lever 33 which is movable about a pivot, in the present embodiment torque bar 81 coupled to the heating chamber 13 via brackets 79 and 83. The torque bar 81 is allowed to pivot within the brackets, thus engaging or disengaging the door 37. The torque bar 81 is coupled to the door via pivot flange 85, which is in turn pivotally coupled to the twist arm 35. The pivotal coupling between the twist arm and the torque arm via the pivot flange allows the pivotal movement of the torque bar 81 to translate to an engagement or disengagement of the door 37 with respect to the opening 67. The twist arm 35 is coupled to the door 37 by such means as welding or bolts, or other suitable means.

The operation of the gating means is also exemplified in FIG. 3, wherein the engaged position is indicated by arrow E, and the disengaged position is indicated by arrow D. There is a continuum of movement between the extreme E and D positions in the present embodiment of the gating means. For example, the grip lever 33 could be placed towards the E position only partially, thus allowing the door 37 to create only a partial opening from opening 67. The liquid or semi-liquid material 101 then flows from the partial opening created by the gating means. The door 37 is typically fitted flush against the outside wall of gating channel 87, thus forming a seal around the opening 67 and containing the liquid or semi-liquid material the containment chamber 59.

The liquid or semi-liquid state of the material is obtained and maintained by applying heat created by fuel burners such as fuel burner 45. This fuel burner is shown coupled to the fuel line 51 and having a fuel control valve 50 for adjusting the amount of fuel, and hence the level of heating, within the heating chamber 13. The fuel burner 45 is coupled to the retort tube at retort inlet 75 (shown in FIG. 2).

Figure 4:
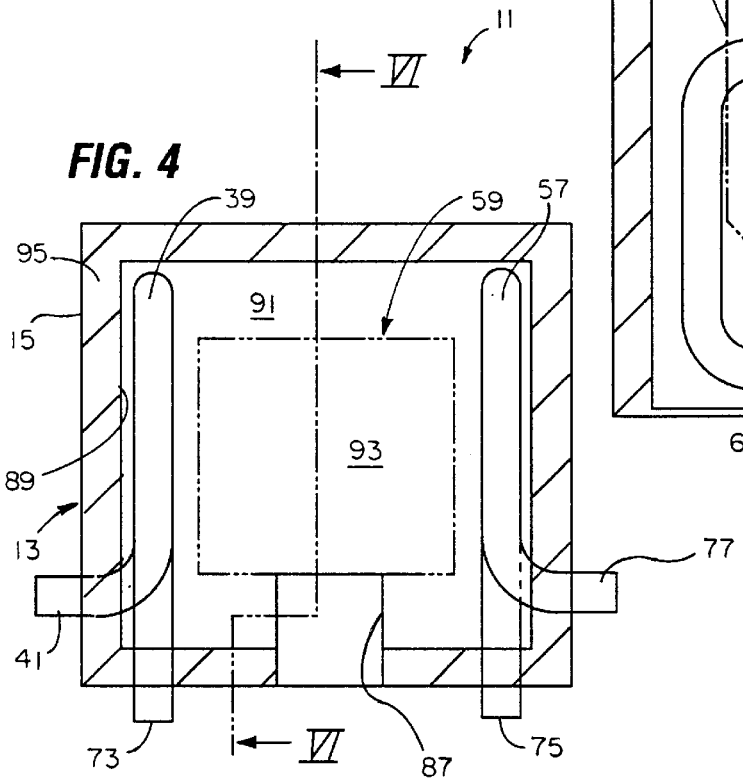
FIG. 4 is a cutaway top view of the cart of the invention.
Figure 5:
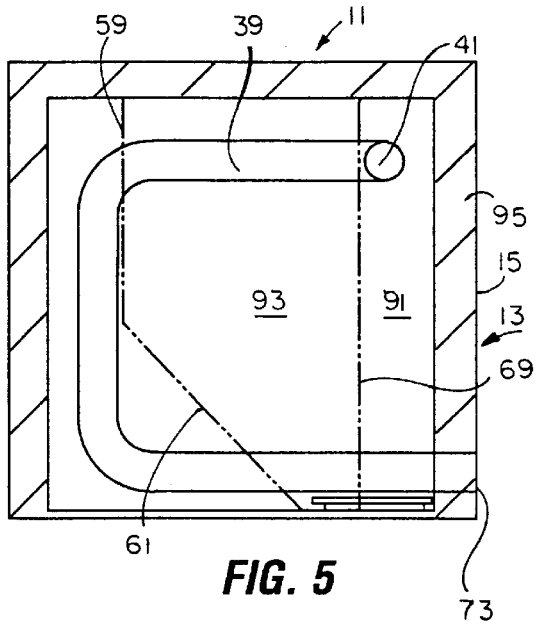
FIG. 5 is a cutaway side view of the cart of the invention.

Referring now to FIGS. 4 and 5 are shown various aspects of the interior of the cart 11. The heating chamber 13 having exterior 15 is shown also having an interior surface 89, thus creating an enclosed interior 91. Within the walls between the surface 15 and 89 is insulation 95. This insulation reduces heat transfer between the enclosed interior 91 once heated and the surface 15, thus allowing its safe use. Heat is created within the enclosed interior by retort tubes 39 and 57. Asphaltic/polymeric material is thus heated while within the containment chamber 59, the chamber 59 being located within the enclosed interior 91 of cart 11. The contact between the radiant heated air within the enclosed interior 91 and the containment chamber 59 is thus translated to the material within the containment chamber interior 93.

Referring further to FIGS. 4 and 5, heated material within the containment chamber 59 is urged towards the opening 67 by the sloped sides, and in particular the sloped back face 61. The sloped faces narrow towards the opening 67 relative to the top of the containment chamber 59, and gravity thus causes the liquid or semi-liquid material to flow out of the opening and onto a road or pavement surface for repairs.

Figure 6:
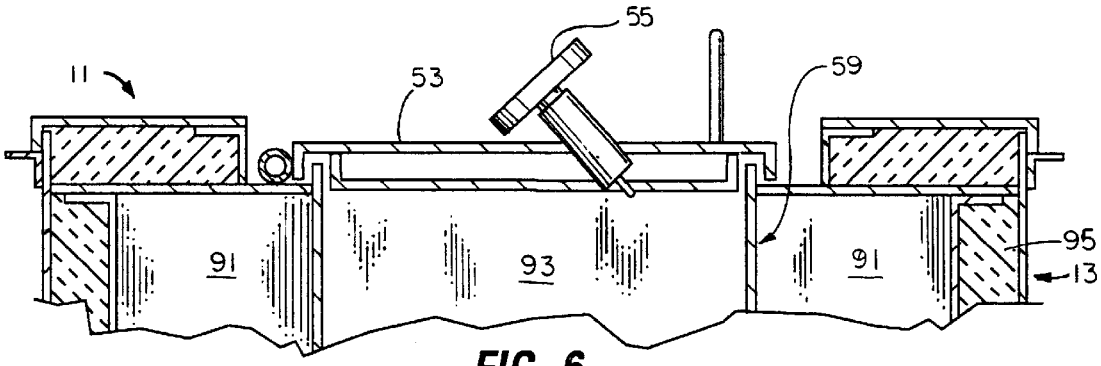
FIG. 6 is a cutaway side view of the top of the cart of the invention.

Another cross-section of the cart 11 is shown with reference to FIG. 6. This view highlights the top 53 of the cart 11, as well as the insulation 95 located within the walls of the heating chamber 13. The thermometer 55 extends into the chamber interior 93 in order to measure the temperature of heated material inside. Insulation 95 typically surrounds the enclosed interior, and is made from a suitable material such as non-flammable fiberglass or asbestos fibers.

Figure 7:
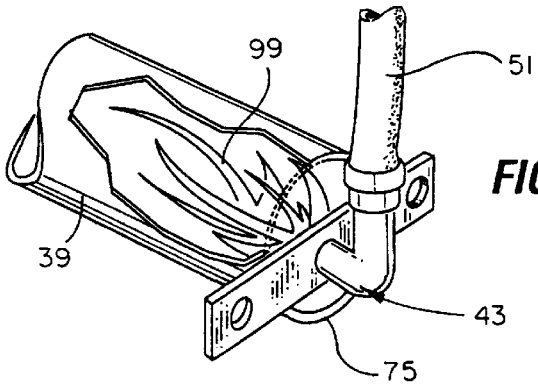
FIG. 7 is a close-up view of the fuel burner of the invention.

The fuel burner is shown in greater detail in FIG. 7, wherein the fuel burner 43 is coupled to the retort inlet 73 by suitable means and producing a flame 99 within the retort tube 39. This flame gets its supply of fuel from the fuel tank 27 in communication with the fuel burner 43 via lines 51. The flame heats the interior of the retort tube, typically made from a conductive metal such as iron, an thus thermally conducting heat to the surrounding space within the enclosed interior 91. This in turn heats the containment chamber 59, and the material within the chamber in the chamber interior 93.

The apparatus of the invention also utilizes a new class of pavement repair materials or "asphaltic/polymeric" materials. These materials are commercially available as "ROADPATCH", and "HOTCRETE" from H.D. Industries, Inc. of Jacksonville, Tex. and "FIBRESCREED" from Applied Polymerics of Mountain Airy, N.C. The commercial specifications for each product are described briefly below.

ROADPATCH Materials Test Specifications
Technical Data

| | |
|---|---|
| Color | Black or concrete colored |
| Form | Solid |
| Specific Gravity | 2.0 |
| Application Temperature | 150–200 degrees Centigrade |
| Maximum Safe Heating Temperature | 210 degrees Centigrade |
| Surface Applications | All concrete and asphalt surfaces |
| Application Thickness | 75 mm plus |
| Curing Time | 10–60 min., depending on ambient air temp. |
| Shelf Life | Unlimited |
| Packaging | 3-ply silicon lined paper bags (50 lb.) |
| Flash Point | 250 degrees Centigrade |

ROADPATCH is a hot poured repair material with a 10–14% bitumen content containing polymers and grated fillers which produce an impermeable, voidless mass solid at ambient temperatures. The material is formulated to be utilized as a one repair material on both concrete and asphalt surfaces, including bridge decks. It is primarily intended to be utilized for asphalt repairs but can be utilized for concrete repairs as well. Surface preparation is minimal. Once the material has set up, it forms an impermeable seal to the adjacent material that is impervious to water and chemical intrusion. The material is self-leveling and requires no compaction to remain in place. The natural adhesive properties of the material ensure that it will adhere to the repair area without any type of preliminary tack coat for asphalt repairs. The material can be re-heated and applied with no adverse results and minimal cure time is required.

| HOTCRETE Material Testing Specifications Technical Data | |
|---|---|
| Color | Gray (concrete colored) |
| Form | Powder until heated and applied |
| Specific Gravity | 2.0 |
| Application Temperature | 180–210 degrees Centigrade |
| Maximum Safe Heating Temperature | 220 degrees Centigrade |
| Surface Applications | All concrete surfaces, including bridge decks |
| Application Thickness | 8–10 mm plus |
| Curing Time | 10–20 min., depending on ambient air temp. |
| Shelf Lite | Unlimited |
| Packaging | Polypropylene bags (50 lbs.) |
| Flash Point | 220 degrees Centigrade |

HOTCRETE is a hot poured polymer modified hydrocarbon resin binder with grated fillers. It produces an impermeable, voidless mass that is solid at ambient temperatures. It is formulated to be utilized as a one repair material on concrete surfaces, including bridge decks. It can be utilized over movement joints such as expansion joints in concrete. It is recommended that a concrete primer be utilized over the damaged area prior to applying HOTCRETE. The primer hinders the intrusion of water into the repair from below and enhances the adhesion properties of the material.

FIBRESCREED is a hot applied bitumen based produced containing mineral fillers and synthetic fibers. The material is used as a flexible joining and repair material for asphalt and concrete highways. The material has a block appearance, a specific gravity of at 25° C. of 1.5 g $cm^{-3}$ and is insoluble in water, the material contains, in addition to it bitumen content, an amine wetting agent, rubber tire crumbs, sand, mineral filler and synthetic fibers. The material also has the following observed characteristics:

| | |
|---|---|
| Mandrel Test 180° C. Bend, 23° C. | Pass |
| Cone Flow Test (%) (70° C., 3 Hours) | 10 (max) |
| Density (Kg/l) | 1.6–1.8 |
| Compression Resistance (N) (10 mm per minute, 23° C.) | 400 (min) |
| Extension Test (N) (1 mm per minute, 23° C.) | 750 (max) |
| Extension Test (%) (1 mm per minute, 23° C.) | 100 (min) |
| Skid Resistance (Surface Dressed) | 55 (min) (High PSV Grit) 70 (min) (Calcined Bauxite) |

These materials all include an asphaltic binder, as did the prior art materials, but also include a synthetic, polymeric component. The pavement repair materials used in the method of the invention do not require a separate aggregate stone mixing step, do not require a compaction step, and are self-leveling. Yet, the materials are compatible with the asphalt or concrete pavements and stand up to demanding conditions of even heavily traveled interstate highways and city streets.

In operation, the asphaltic/polymeric binder material selected for the intended application can be added directly to the containment chamber of the cart at the top of the unit. The material is allowed to heat adequately, the intended application temperature being between about 150 to 210° C., preferably about 165–195° C. The temperature is controlled to ensure that the material is never heated above about 210° C. The material is ultimately heated to a liquid or semi-liquid state that is fluid and homogeneous.

The pothole, crack, or other road surface imperfection is then prepared by cleaning the area of loose debris with a commercially available gas/air lance. A pavement breaker can be utilized to prepare the hole or remove any large debris. A pavement saw can also be utilized to shape the pothole if required.

If the repair is to made in concrete, it is generally advisable to coat the application area with a suitable concrete primer. The concrete primer should have a minimum penetration into the concrete of 2–5 mm and have a rapid curing rate. Any primer can be utilized which is compatible with the pavement repair materials previously described. No primer is needed for asphalt repairs.

The pavement repair material is then dispensed from the mixing chamber through the outlet chute into the repair area. For deep repairs, it may be necessary to "bulk out" the repair area by first placing a layer of clean, dry aggregate onto the application surface and then adding the pavement repair material. The "bulk out" process will increase the compressive loading capacity of the ultimate repair.

The material can be smoothed with a smoothing/leveling iron to ensure adequate coverage into all crevices and cracks. The leveling irons are preferably stored in a heated storage compartment when not in use. No compaction equipment is necessary and the material is also self leveling after being initially smoothed.

A dressing of 2 mm to 6 mm clean, dry and heated aggregate can be applied to the surface of the completed patch for enhanced traction if desired. The aggregate should be heated prior to application to the asphaltic binder material by utilizing a heated mixer drum. The aggregate drum can be heated with the gas/air lance utilized for preparing the application surface. Water can be applied to the surface of the repair material after it is in place to speed the curing time, if necessary. Water can be applied by means of a mist or spray applicator.

For repairing longitudinal cracks in concrete or asphalt pavements, the cracks should generally first be milled out using a hydraulically powered cold planar. For example, a crack is typically milled to a depth of ¾ inch to 1 inch and shall be milled out a maximum of 4–6 inches on both sides of the crack itself. After the milling of the crack has been completed, the crack is cleaned using, for example the gas/air lance. The cleaned repair area should then be coated with a suitable primer, as previously described, for concrete surfaces. No primer is required for asphalt crack repairs. The pavement repair material which has been heated in the mixing chamber is then applied to the area, for example, by using a screed box. A finish application of 2–6 mm of heated, clean dry aggregate can be applied to the surface of the binder material if desired.

The present invention has several advantages over the prior art. Although labeled as "portable", none of the prior art asphalt hoppers is operable and moveable by one person as is the cart of the present invention. The hoppers used to heat and stir asphalt in the prior art involve truck-mounted or tailor mounted hoppers having mechanized stirring or agitating devices therein. The present cart is lightweight and simple, ideal for small jobs and jobs that require the application of a narrow channel of material. Further, the present invention is adapted to the new asphaltic/polymeric materials such as the ROADPATCH and ROADFLEX materials described above.

Another advantage to the present invention is the relative simplicity of the cart relative to prior art devices. The cart requires no mechanized parts, although it can be mechanized to control the gating means if desired. A sloped containment chamber urges the liquid or semi-liquid materials out of the cart and onto the road in a controlled manner, the user being able to manually adjust the flow level and flow amount.

While the invention has been shown in only one of its forms, it is not thus limited but is susceptible to various changes and modifications without departing from the spirit thereof.

What is claimed is:

1. A portable cart for transporting and dispensing heated pavement repair materials that is capable of being moved and operated by one person, the cart applying a heated asphaltic/polymeric binder material, the cart comprising:

a heating chamber having an enclosed interior and a dry, radiant heat source;

a containment chamber located within the enclosed interior of the heating chamber, the containment chamber narrowing towards an opening, wherein the dry, radiant heat source is a pair of burner-fired retort tubes located in the heating chamber, the retort tubes being generally U-shaped and oriented along a generally-vertical plane, one of the retort tubes being positioned adjacent one of a pair of opposing sides of the containment chamber, the other of the retort tubes being positioned adjacent the other of the pair of opposing sides;

wherein the radiant heat source within the heating chamber heats the material within the containment chamber to between about 150° C. and 210° C.; and wherein the heating chamber having the containment chamber there within is located upon a hand-driven cart.

2. The cart of claim 1, further comprising a hand-operated gating means.

3. The cart of claim 2, wherein the hand operated gating means allows the heated material to flow from the opening when in an engaged position.

4. The cart of claim 1, wherein the material within the containment chamber is gravity-dispensed.

5. The cart of claim 1, wherein a tank of combustible fuel is provided on the cart to supply fuel to the heat source.

6. A portable cart for transporting and dispensing heated pavement repair materials that is capable of being moved and operated by one person, the cart applying a heated asphaltic/polymeric binder material, the cart comprising:

a heating chamber having an enclosed interior and a dry, radiant heat source;

a containment chamber located within the enclosed interior of the heating chamber, the containment chamber having a sloped back face and sloped sides that, in combination, narrow towards an opening controlled by a hand-operated gating means;

wherein the dry, radiant heat source is a pair of burner-fired retort tubes located in the heating chamber, the retort tubes being generally U-shaped and oriented along a generally-vertical plane, one of the retort tubes being positioned adjacent one of a pair of opposing sides of the containment chamber, the other of the retort tubes being positioned adjacent the other of the pair of opposing sides; and wherein the heating chamber having the containment chamber there within is located upon a hand-driven cart.

7. The cart of claim 6, wherein the radiant heat within the heating chamber heats the material within the containment chamber to between about 150° C. and 210° C., thus creating a fluid material that flows by gravity from the opening.

8. The cart of claim 6, wherein the hand operated gating means allows the heated material to flow from the opening when in an engaged position.

9. The cart of claim 6, wherein a tank of combustible fuel is provided on the cart to supply fuel to the heat source.

* * * * *